US008267290B2

(12) United States Patent
Schlipper

(10) Patent No.: US 8,267,290 B2
(45) Date of Patent: Sep. 18, 2012

(54) BAG WITH REINFORCED ADJUSTABLE SHOULDER STRAP

(76) Inventor: Robert Wesley Schlipper, Hong Kong (HK)

( * ) Notice: Subject to any disclaimer, the term of this patent is extended or adjusted under 35 U.S.C. 154(b) by 1240 days.

(21) Appl. No.: 11/878,179

(22) Filed: Jul. 23, 2007

(65) Prior Publication Data

US 2008/0156835 A1 Jul. 3, 2008

(30) Foreign Application Priority Data

Jan. 3, 2007 (AU) ..... 2007900026

(51) Int. Cl.
*A45F 3/14* (2006.01)
*A45F 3/00* (2006.01)

(52) U.S. Cl. ..... 224/264; 224/627; 224/259; 224/643

(58) Field of Classification Search ..... 224/643, 224/627, 614–622, 631, 642, 645, 647, 651, 224/257–259, 264
See application file for complete search history.

(56) References Cited

U.S. PATENT DOCUMENTS

| | | | | |
|---|---|---|---|---|
| 3,875,771 | A * | 4/1975 | Reisner | 70/18 |
| 4,233,713 | A * | 11/1980 | Berg | 24/191 |
| 5,181,638 | A * | 1/1993 | McHale | 224/637 |
| 5,660,312 | A * | 8/1997 | Suzuki | 224/627 |
| 5,730,347 | A * | 3/1998 | Finot | 224/631 |
| 5,860,769 | A * | 1/1999 | Seligman | 405/186 |
| 6,026,662 | A * | 2/2000 | Schlipper | 70/18 |
| 6,199,412 | B1 * | 3/2001 | Kennedy | 70/18 |
| 6,244,081 | B1 * | 6/2001 | Schlipper | 70/18 |
| 6,510,717 | B1 * | 1/2003 | Levi | 70/18 |
| 6,626,335 | B1 * | 9/2003 | Dunlop | 224/258 |
| 6,802,442 | B1 * | 10/2004 | Thompson | 224/637 |
| 7,454,932 | B2 * | 11/2008 | Hollier | 70/18 |
| 2003/0010801 | A1 * | 1/2003 | Schlipper | 224/660 |
| 2003/0110818 | A1 * | 6/2003 | Schlipper | 70/18 |
| 2005/0005343 | A1 * | 1/2005 | Johnson | 2/102 |
| 2006/0032883 | A1 * | 2/2006 | Moreno et al. | 224/627 |
| 2007/0251279 | A1 * | 11/2007 | Hollier | 70/15 |

FOREIGN PATENT DOCUMENTS

EP 1688059 A2 * 8/2006

* cited by examiner

*Primary Examiner* — Justin Larson
*Assistant Examiner* — Corey Skurdal

(57) ABSTRACT

A shoulder strap assembly includes a shoulder-engaging portion to which a buckle is fixed and a length-adjustable strap which cooperates with the buckle. The length-adjustable strap includes a portion reinforced by metal threads connected to metal threads provided adjacent the fabric wall of the bag to deter cutting through the strap. The reinforced portion of the length-adjustable strap extends through a longitudinal aperture in the shoulder-engaging portion and an unreinforced portion of the strap is provided to extend in a loop around part of a tension-locked buckle.

7 Claims, 3 Drawing Sheets

BAG WITH REINFORCED ADJUSTABLE SHOULDER STRAP

TECHNICAL FIELD

The present invention relates generally to bags with shoulder straps and, more particularly, to bags having length-adjustable shoulder straps reinforced to deter cutting and thus provide improved security against theft.

BACKGROUND OF THE INVENTION

Shoulder strap assemblies used in bags, such as backpacks, typically use a two-part construction. An upper shoulder-engaging part of the strap assembly may include some cushioning for improved comfort and has one end fixed to the bag and the other end to a buckle. To adjust the length of the strap assembly a plain strap is fixed at a lower end of the bag and engages the buckle. In the conventional tension-locked buckle used in this application, the plain strap passes in a tight loop around a limb of the buckle, being firmly held in position when tensioned. This plain strap must be sufficiently flexible to cooperate with such a buckle and may be made from a woven or knitted synthetic fabric, leather or a like material.

For improved security of backpacks and other soft luggage, particularly against cutting, wire-reinforced fabrics have been used. In some constructions a wire mesh fabric may be laminated between the outer shell and the inner liner of the bag to provide improved security. However un-reinforced straps remain a point of weakness when the bag is being carried as they may readily be cut through by a hand-wielded blade, allowing a thief to quickly steal the complete backpack from the person carrying it. It should be noted that the term "backpack" is used herein in a broad sense to refer to any bag having a shoulder strap or waist strap by which it may be carried.

Parts of the strap assembly that are not readily visible when walking are vulnerable to being cut in this manner. Most vulnerable is the plain strap at the lower end, as it is also generally of minimum transverse dimensions and sits spaced apart from the carrier's body. Another vulnerable section is that extending generally behind the top of the carrier's shoulders to attach to the top of the backpack. While there is a need for improved security, particularly of these vulnerable portions, any new backpack shoulder strap should use conventional components as far as possible, to be cost-competitive.

It is an object of the present invention to overcome or substantially ameliorate at least one of the above disadvantages or more generally to provide an improved backpack having an adjustable shoulder strap assembly able to deter cutting.

DISCLOSURE OF THE INVENTION

According to one aspect of the present invention there is provided a bag a shoulder strap assembly fixed thereto for carrying the bag, the shoulder strap assembly comprising:

an elongate shoulder-engaging portion having a proximal end fixed to the bag and an opposing distal end;

a buckle fixed to the shoulder-engaging portion intermediate the proximal and distal ends of the shoulder-engaging portion;

a longitudinal aperture extending from a mouth opening at the distal end of the shoulder-engaging portion, and a length-adjustable strap having a proximal end connected to the bag and cooperating with the buckle for adjusting the length of the strap assembly, the length-adjustable strap including a reinforced portion extending longitudinally from its proximal end that is reinforced by metal threads to deter cutting, at least part of the reinforced portion being received in the aperture.

Optionally the proximal end of the shoulder-engaging portion may be fixed to the bag by length-adjustable means, such as a strap and adjustable fastener. This would allow, for instance, the position of the buckle along the strap assembly to be varied for convenient placement as may be desirable to suit people of different sizes.

Preferably the longitudinal aperture extends between the distal end of the shoulder-engaging portion and the buckle, the length-adjustable strap includes a longitudinally extending unreinforced portion unreinforced by metal threads and configured to engage the buckle, the buckle being of the tension-locked type having a limb around which a loop in the unreinforced portion passes. Simply reinforcing all the parts of the strap with metal threads is unsatisfactory since the resulting increased stiffness means it cannot conform to provide the necessary tight loop when passing through the conventional buckle.

A section of the shoulder-engaging portion substantially between the proximal end of the shoulder-engaging portion and the buckle is preferably reinforced by metal threads to deter cutting. Preferably a section of the shoulder-engaging portion substantially between the distal end of the shoulder-engaging portion and the buckle is reinforced by metal threads to deter cutting.

The metal threads are preferably formed as twisted wire cables, the reinforced portion of each length-adjustable strap including a sheath fixed to each of the opposing longitudinal edges of the length-adjustable strap, each sheath receiving one of the twisted wire cables.

Most preferably the bag has a fabric wall with wall-reinforcing metal threads that extend through or adjacent the fabric wall to deter cutting, and wherein the metal threads reinforcing the length-adjustable strap are fixed to or adjacent to the wall-reinforcing metal threads.

By providing metal threads reinforcing the length-adjustable strap which is connected to or adjacent the metal threads adjacent the fabric wall of the bag the level of security against cutting is increased. Reinforcing only the lower portion of the length-adjustable strap allows this improved level of security to be obtained in a manner which minimizes manufacturing costs and maximizes performance.

Preferably the proximal end is releasably connected to the bag by engagement of first and second parts of a two-part coupling, the first part of the two-part coupling fixed to the bag and the second part fixed to the proximal end of the length-adjustable strap.

By providing metal threads reinforcing the length-adjustable strap which are connected to or adjacent the metal threads adjacent the fabric wall of the bag the level of security against cutting is increased. Reinforcing only the lower portion of the length-adjustable strap allows this improved level of security to be obtained in a manner which minimizes manufacturing costs and maximizes performance.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
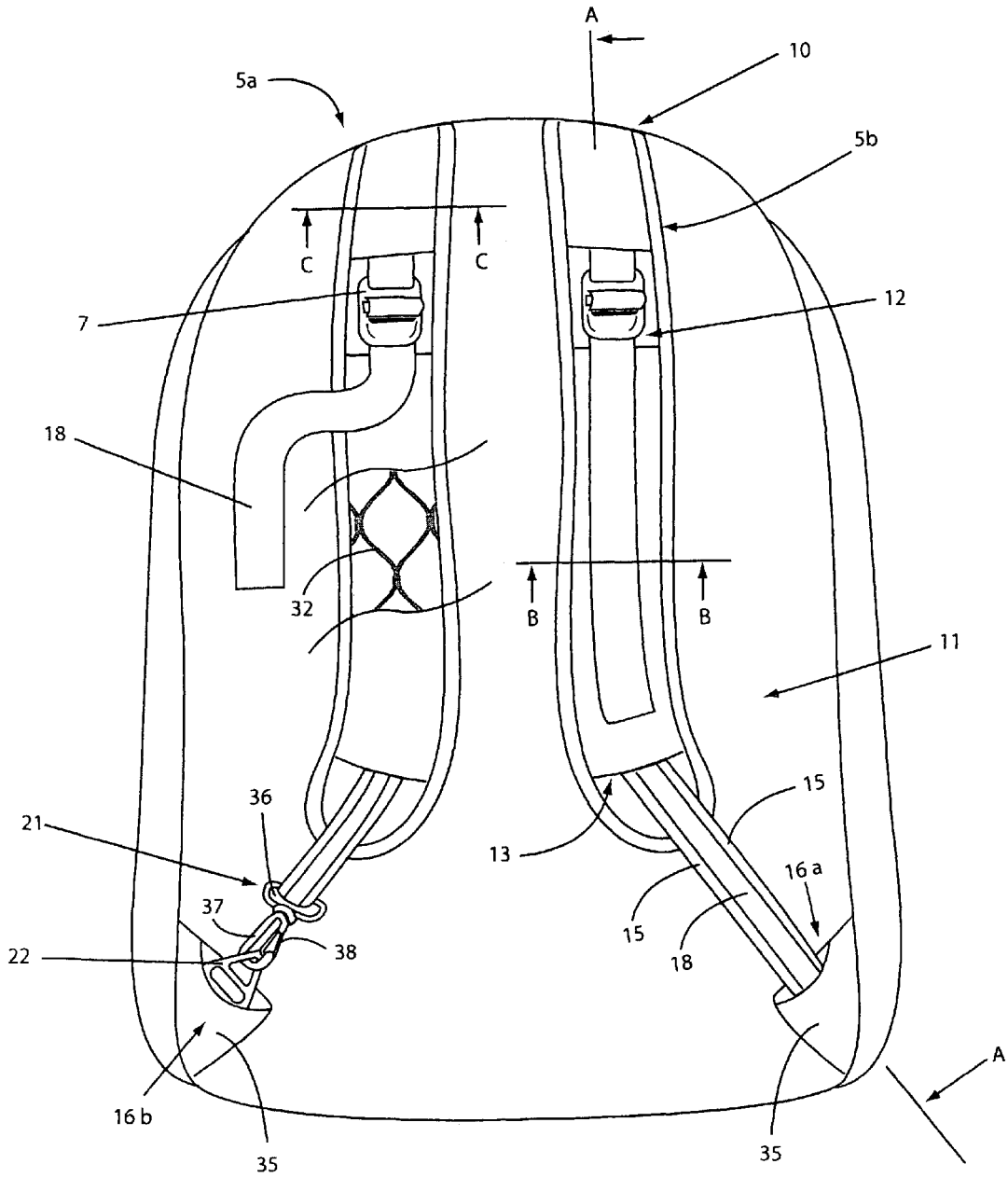
FIG. 1 is a front view of the bag of the present invention.
Figure 2:
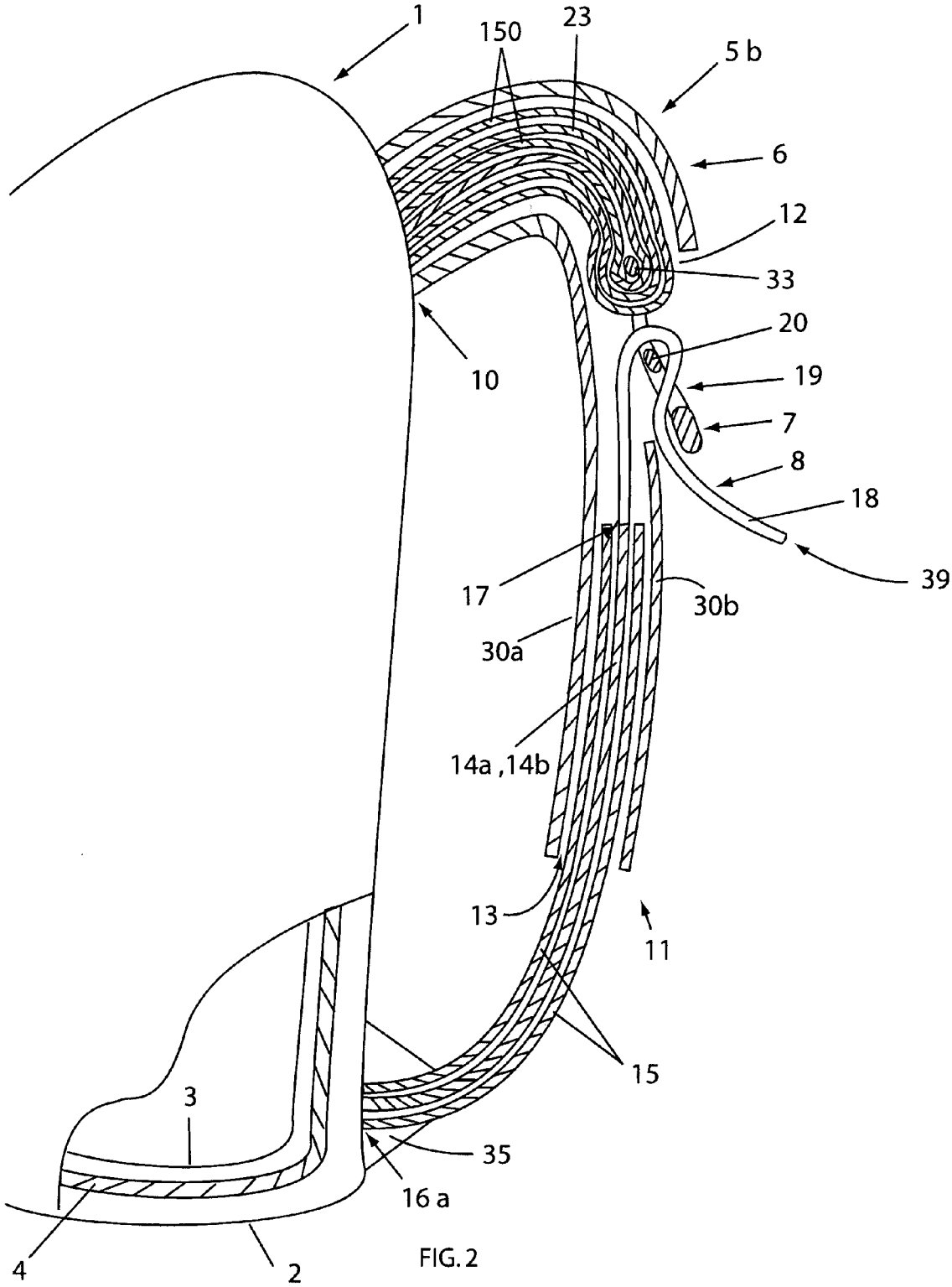
FIG. 2 is a schematic section along line AA of FIG. 1.
Figure 3:
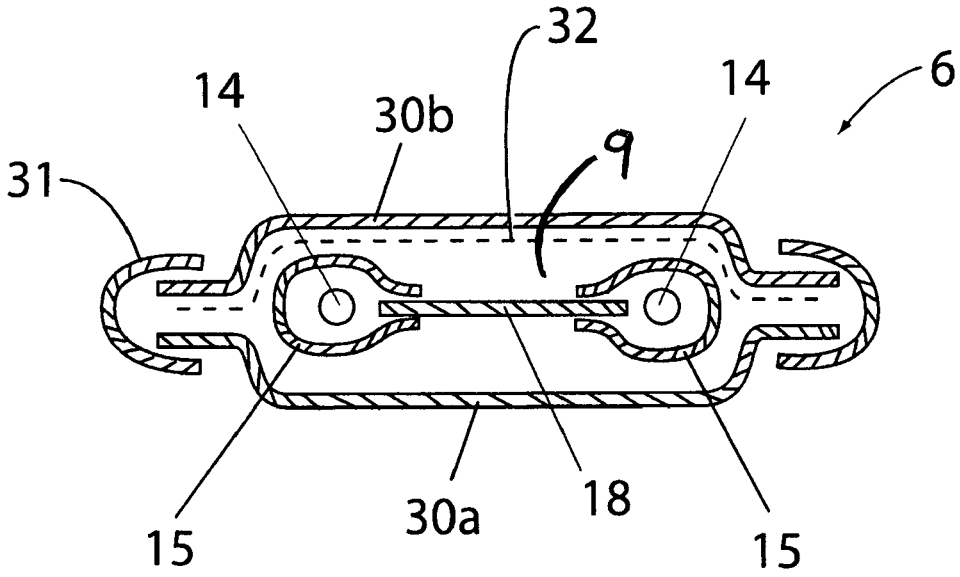
FIG. 3 is a schematic section along line BB of FIG. 1.
Figure 4:
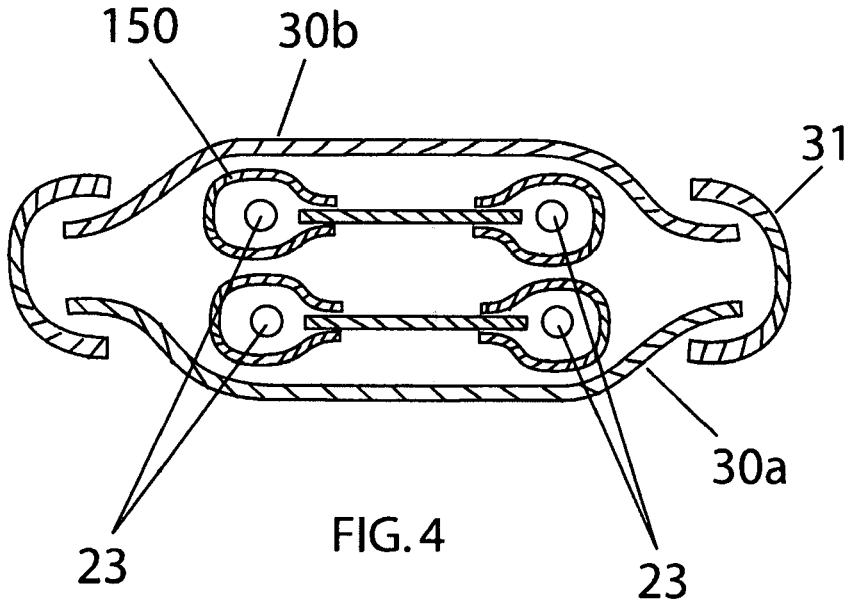
FIG. 4 is a schematic section along line CC of FIG. 1.

Referring to the drawings, the bag of the invention is a backpack 1 constructed with an outer fabric wall 2 and an inner fabric lining 3 between which a wire mesh is laminated. The mesh is made of strands of cable 4 each made from a plurality of twisted metal threads.

Each of the two shoulder strap assemblies 5*a*, 5*b* includes a shoulder-engaging portion 6 and a length-adjustable strap 8 connected by a buckle 7, and both strap assemblies 5*a*, 5*b* are of like construction except for their attachment at the bottom of the bag as described below.

The shoulder-engaging portion 6 is generally in the form of an elongate fabric sleeve formed from inner and outer strips 30*a*, 30*b*, that is generally oblong in cross-section. An aperture 9 bounded by the strips 30*a*, 30*b* extends longitudinally from a mouth 13 at the distal end 11 to a closed end where the shoulder-engaging portion 6 is fixed to the backpack at its proximal end 10. Within the sleeve formed by strips 30*a*, 30*b*, adjacent to and substantially coextensive with the outer fabric strip 30*b* is an elongate mesh panel 32 formed from twisted metal threads. The longitudinal edges of the panel 32 are received between the edges of the strips 30*a*, 30*b* and they are sewn together with folded edge tapes 31 to form the sleeve.

The shoulder-engaging portion 6 further includes a pair of wire cables 23 that extend inside an upper section of the shoulder-engaging portion 6. Each cable 23 is received in a sheath 150 fixed to lengthwise edges of a tape. The tape, sheaths 150 and cables 23 extend in a loop around a transverse arm 33 of the buckle 7 with both of the cable ends secured at the proximal end 10 to the wall 2 (extending through a seam to the inner wall 3), or alternatively to the mesh 4. Likewise the sleeve formed by strips 30*a*, 30*b* is fixed at the proximal end 10 to the upper end of the wall 2 of the backpack 1.

The buckle 7 is fixed to the shoulder-engaging portion 6 intermediate its proximal and distal ends 10, 11 in a transverse opening 12 in the outer strip 30*b*.

The length-adjustable strap 8 comprises a flexible, unreinforced woven fabric strap portion 18 extending from each proximal end 16*a*, 16*b* where it is fixed to the lower end of the backpack 1, to its free distal end 39. Reinforcing the lower part of the length-adjustable strap 8 below the transverse line 17 are a pair of cables 14 each made from a plurality of twisted metal strands. Each of the two cables 14 is received in a respective one of two sheaths 15 fixed to the lengthwise edges of the strap portion 18. The proximal ends 16*a*, 16*b* of the length-adjustable straps 8 fixed to the lower end of the backpack 1 illustrate alternative attachments between the backpack 1 and the cables 14.

Two flaps 35 reinforce opposing bottom corners of the backpack 1, each being fixed at the intersection of the back and side walls. At the proximal end 16*a*, as best seen in FIG. 1, the cables 14 are fixed, by sewing for instance, to the flap 35 fixed at the intersection of the back and side walls of the backpack 1. The flaps 35 are made from tough and flexible fabric and the ends of the cables 14 terminate in the seam, and are fastened, closely adjacent to the mesh 4, making them extremely difficult to sever using a handheld blade and therefore deterring such cutting at or near the cable ends.

At the proximal end 16*b*, as best seen in FIG. 1, the cables 14 are fixed to a releasable end fitting 21. The end fitting 21 is preferably formed of metal and includes an opening 36 through which the cables 14 are fastened, and a hook 37 with a resilient keeper 38. The hook 37 engages a substantially triangular metal eye 22 secured to the flap 35. The hook 37 and eye 22 provides a two-part coupling that is invulnerable to being sliced by a blade so it likewise provides a deterrent to cutting, and as release of the keeper 38 and removal of the hook takes some time to manipulate, the strap assembly 5*a* can be secured about an object and fastened by the hook and eye, for assist in preventing casual theft of the backpack.

The reinforced portion comprising the sheathed cables 14 passes through the mouth 13 in the distal end 11 of the sleeve. The buckle 7 is of the tension-locked type and the unreinforced strap portion 18 passes in a loop about the limb 20 of the buckle 7. As the sheathed cables 14 cannot pass through the buckle 7, the position of the ends of the cables at line 17 defines the shortest dimension that can be obtained for the strap assembly 5. When the length of the strap assembly 5 is at its maximum at least part of the sheathed cables 14 is received in the aperture 9 so as not to expose the vulnerable unreinforced strap portion 18.

Moreover, by providing reinforcement of the length-adjustable strap 8 in the form of the sheathed cables 14 on the edges thereof, a clear deterrent is provided to any potential thief. The longitudinal extent of the sheathed cables 14 is hidden from view by the sleeve any attempt to cut in these lower portions would also be prevented. The buckles 7 are positioned adjacent the carrier's shoulders for security, so that the un-reinforced strap section passing around the limb 20 is placed in the carrier's normal field of vision.

Aspects of the present invention have been described by way of example only and it should be appreciated that modifications and additions may be made thereto without departing from the scope thereof.

The invention claimed is:

1. A bag having a shoulder strap assembly fixed thereto for carrying the bag, the shoulder strap assembly comprising:

an elongate shoulder-engaging portion having a proximal end fixed to the bag and an opposing distal end;

a tension-locked buckle having a limb, the buckle being fixed to the shoulder-engaging portion at an intermediate position intermediate the proximal and distal ends of the shoulder-engaging portion, the intermediate position lying adjacent the user's shoulder in use;

a longitudinal aperture in the shoulder-engaging portion, the longitudinal aperture extending from a first mouth at the intermediate position to a second mouth at the distal end of the shoulder-engaging portion, and a length-adjustable strap having a proximal end connected to the bag and an opposing free end, the length-adjustable strap comprising a reinforced portion reinforced by metal threads to deter cutting and an unreinforced portion unreinforced by metal threads, the reinforced portion extending longitudinally from the proximal end, the unreinforced portion extending longitudinally from the free end and passing in a loop around the limb of the buckle for adjusting the length of the part of the length-adjustable strap that extends between the buckle and the proximal end of the length-adjustable strap, at least part of the reinforced portion being received in the longitudinal aperture and at least part of the unreinforced portion extending through the first mouth.

2. The bag of claim 1 wherein a section of the shoulder-engaging portion substantially between the proximal end of the shoulder-engaging portion and the buckle is reinforced by metal threads to deter cutting.

3. The bag of claim 2 wherein a section of the shoulder-engaging portion substantially between the distal end of the shoulder-engaging portion and the buckle is reinforced by metal threads to deter cutting.

4. The bag of claim 1 wherein the metal threads are formed as twisted wire cables.

5. The bag of claim 4 wherein the reinforced portion of each length-adjustable strap has a pair of longitudinal edges, and wherein a sheath extends along each of the longitudinal edges, each sheath receiving one of the twisted wire cables.

6. The bag of claim 1 wherein the bag has a fabric wall with wall-reinforcing metal threads that extend through or adjacent the fabric wall to deter cutting, and wherein the metal threads reinforcing the length-adjustable strap are fixed to or adjacent to the wall-reinforcing metal threads.

7. The bag of claim 1 wherein the proximal end of the length-adjustable strap is releasably connected to the bag by engagement of first and second parts of a two-part coupling, the first part of the two-part coupling fixed to the bag and the second part fixed to the proximal end of the length-adjustable strap.

* * * * *